US011980302B2

(12) United States Patent
Takenaka et al.

(10) Patent No.: US 11,980,302 B2
(45) Date of Patent: May 14, 2024

(54) AIR BLOWER

(71) Applicant: DAIKIN INDUSTRIES, LTD., Osaka (JP)

(72) Inventors: Kei Takenaka, Osaka (JP); Yousuke Imai, Osaka (JP); Yuusuke Taruki, Osaka (JP); Keita Kawahara, Osaka (JP); Aya Okuno, Osaka (JP); Masahiko Chouji, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 745 days.

(21) Appl. No.: 17/106,780

(22) Filed: Nov. 30, 2020

(65) Prior Publication Data

US 2021/0076849 A1 Mar. 18, 2021

Related U.S. Application Data

(63) Continuation of application No. PCT/JP2019/021979, filed on Jun. 3, 2019.

(30) Foreign Application Priority Data

Jun. 1, 2018 (JP) ..... 2018-106429
Jun. 1, 2018 (JP) ..... 2018-106431

(51) Int. Cl.
*A47G 1/06* (2006.01)
*F04D 17/00* (2006.01)
(Continued)

(52) U.S. Cl.
CPC ..... *A47G 1/0616* (2013.01); *F04D 17/00* (2013.01); *F04D 27/004* (2013.01);
(Continued)

(58) Field of Classification Search
CPC .... A47G 1/0616; F24F 1/0057; F24F 1/0025; F24F 2221/10; F04D 17/00; F04D 27/004; F04D 24/0007
See application file for complete search history.

(56) References Cited

U.S. PATENT DOCUMENTS

2005/0076671 A1* 4/2005 Bae ..... F24F 13/20 62/426
2006/0150463 A1* 7/2006 Kim ..... F24F 13/20 62/331
(Continued)

FOREIGN PATENT DOCUMENTS

JP 1-236014 A 9/1989
JP 4-78455 U 7/1992
(Continued)

OTHER PUBLICATIONS

English Translation of Japanese Notice of Reasons for Refusal for Japanese Application No. 2019-102229, dated Nov. 14, 2022.
(Continued)

*Primary Examiner* — Gary C Hoge
(74) *Attorney, Agent, or Firm* — Birch, Stewart, Kolasch & Birch, LLP

(57) ABSTRACT

An air blower includes: a panel (3); a frame member (5) arranged to surround the panel (3) and having a blowout port (13*a*, 13*b*, 13*c*, 13*d*, 13*e*, 13*f*, 13*g*) of air formed therein; and a fan (11*a*, 11*b*, 11*c*, 11*d*, 11*e*, 11*f*, 30) that sends air to the blowout port (13*a*, 13*b*, 13*c*, 13*d*, 13*e*, 13*f*, 13*g*). The frame member (5) produces airflows that are blown out from at least three directions and collide with each other, thereby producing an air current going forward to the panel (3).

13 Claims, 9 Drawing Sheets

(51) Int. Cl.
*F04D 27/00* (2006.01)
*F24F 1/0025* (2019.01)
*F24F 1/0057* (2019.01)

(52) U.S. Cl.
CPC ..... *F04D 27/007* (2013.01); *F24F 1/0025* (2013.01); *F24F 1/0057* (2019.02); *F24F 2221/10* (2013.01)

(56) References Cited

U.S. PATENT DOCUMENTS

2006/0162212 A1* 7/2006 Kim ..... F24F 1/0073 62/331
2006/0168862 A1* 8/2006 Kim ..... F24F 1/0063 62/331
2006/0185381 A1* 8/2006 Kim ..... F24F 1/0057 62/331
2006/0185382 A1* 8/2006 Kim ..... F24F 13/20 62/331
2008/0028784 A1* 2/2008 Takada ..... F24F 1/0057 62/324.6
2008/0311010 A1 12/2008 Boe
2009/0238685 A1* 9/2009 Santa Ana ..... F04D 25/12 415/182.1
2010/0242518 A1* 9/2010 Yang ..... F24F 1/0057 62/331
2010/0287966 A1* 11/2010 Cha ..... F24F 1/0063 62/263
2015/0132160 A1 5/2015 Ha
2017/0003038 A1* 1/2017 Uda ..... F24F 13/28
2017/0089605 A1* 3/2017 Kim ..... F24F 1/0057
2018/0296957 A1* 10/2018 Yang ..... B43L 1/00
2020/0093291 A1* 3/2020 Liu ..... A61L 9/035

FOREIGN PATENT DOCUMENTS

JP 4-315653 A 11/1992
JP 5-155200 A 6/1993
JP 6-193245 A 7/1994
JP 06193245 A * 7/1994
JP 10-220807 A 8/1998
JP 2003-278376 A 10/2003
JP 2008-540106 A 11/2008
JP 2008-297803 A 12/2008
JP 2010-127603 A 6/2010
JP 2012-47355 A 3/2012
JP 2015-516045 A 6/2015
JP 2016-118193 A 6/2016

OTHER PUBLICATIONS

International Search Report, issued in PCT/JP2019/021979, PCT/ISA/210, dated Jul. 9, 2019.
Extended European Search Report for European Application No. 19810198.2, dated Feb. 17, 2022.

* cited by examiner

AIR BLOWER

CROSS REFERENCE TO RELATED APPLICATIONS

This application is a Continuation of PCT International Application No. PCT/JP2019/021979 filed on Jun. 3, 2019, which claims priority under 35 U.S.C. § 119(a) to Patent Application Nos. 2018-106429 and 2018-106431 filed in Japan on Jun. 1, 2018, all of which are hereby expressly incorporated by reference into the present application.

TECHNICAL FIELD

The present disclosure relates to an air blower.

BACKGROUND ART

Patent Document 1 discloses a pseudo window including a rectangular panel to which a painting or a photograph is attached, and a frame member arranged to surround the panel and produces airflows that are blown out from two opposing edges and collide with each other.

CITATION LIST

Patent Document

Patent Document 1: Japanese Unexamined Patent Publication No. H06-193245

SUMMARY

A first aspect of the present disclosure is an air blower (1) including: a panel (3); a frame member (5) arranged to surround the panel (3) and having a blowout port (13*a*, 13*b*, 13*c*, 13*d*, 13*e*, 13*f*, 13*g*) of air formed therein; and a fan (11*a*, 11*b*, 11*c*, 11*d*, 11*e*, 11*f*, 30) that sends air to the blowout port (13*a*, 13*b*, 13*c*, 13*d*, 13*e*, 13*f*, 13*g*), wherein the frame member (5) blows out airflows that are blown out from at least three directions and collide with each other, thereby producing an air current going forward to the panel (3).

DESCRIPTION OF EMBODIMENTS

First Embodiment

A first embodiment will be described below. The air blower (1) of the present embodiment is provided, for example, on a wall surface of a room, and is used to blow the air in the room.

—General Configuration of Air Blower—

Figure 1:
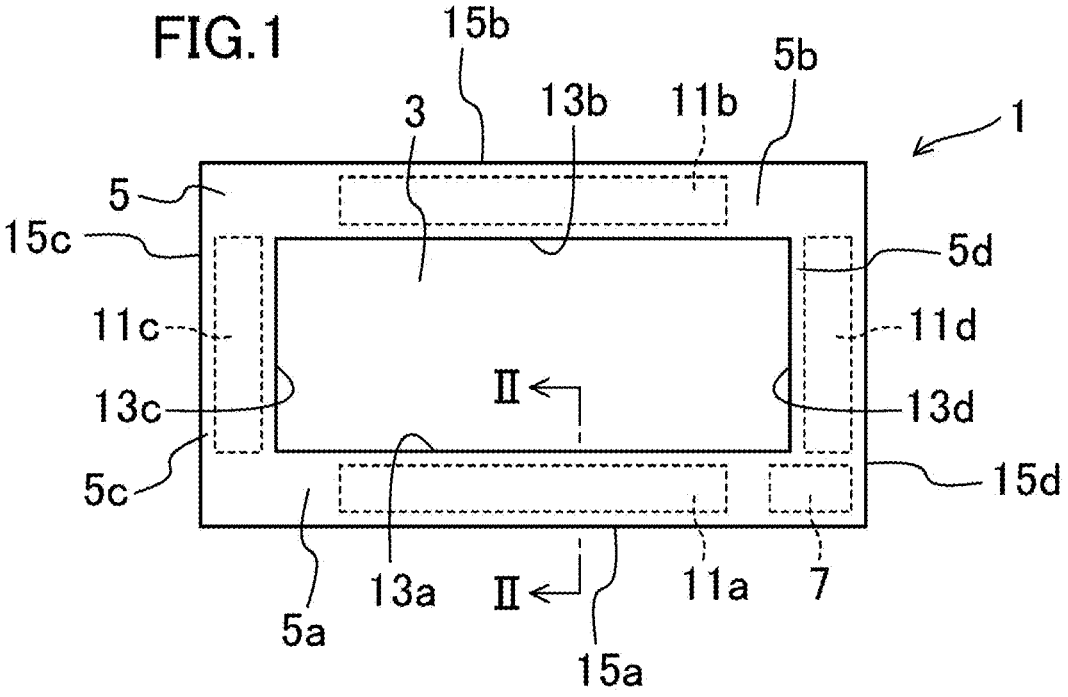
FIG. 1 is a front view illustrating an air blower of a first embodiment.

As shown in FIG. 1, the air blower (1) includes a panel (3), a frame member (5), a plurality of fans (11*a*, 11 *b*, 11*c*, 11*d*), and a controller (7).

The panel (3) is comprised of, for example, a painting, a photograph, and a display that displays an image. The panel (3) may display a still image or a moving image. The panel (3) is formed in a horizontally-oriented rectangular shape, for example.

The frame member (5) is arranged to surround the panel (3). That is, the frame member (5) has a rectangular shape corresponding to the panel (3). Specifically, the frame member (5) includes a first edge portion (5*a*), a second edge portion (5*b*), a third edge portion (5*c*), and a fourth edge portion (5*d*). The first edge portion (5*a*) constitutes a lower one of long sides of the frame member (5). The second edge portion (5*b*) constitutes an upper one of the long sides of the frame member (5). The third edge portion (5*c*) constitutes one of short sides of the frame member (5) on the left side in FIG. 1. The fourth edge portion (5*d*) constitutes one of the short sides of the frame member (5) on the right side in FIG. 1. The first edge portion (5*a*) and the second edge portion (5*b*) face each other with the panel (3) interposed therebetween. The third edge portion (5*c*) and the fourth edge portion (5*d*) face each other with the panel (3) interposed therebetween. The frame member (5) has a hollow inside. Details of the frame member (5) will be described later.

The fans (11*a*, 11*b*, 11*c*, 11*d*) are respectively provided for the first edge portion (5*a*), the second edge portion (5*b*), the third edge portion (5*c*), and the fourth edge portion (5*d*). The fans (11*a*, 11*b*, 11*c*, 11*d*) are, for example, cross-flow fans. Each of the fans (11*a*, 11*b*, 11*c*, 11*d*) is arranged along the corresponding edge portion (5*a*, 5*b*, 5*c*, 5*d*) in which the fan is arranged. The fans (11*a*, 11*b*, 11*c*, 11*d*) send air to blowout ports (13*a*, 13*b*, 13*c*, 13*d*) described below of the corresponding edge portions (5*a*, 5*b*, 5*c*, 5*d*).

The controller (7) is arranged in the frame member (5). The controller (7) adjusts the rotational speeds of the fans (11*a*, 11*b*, 11*c*, 11*d*), for example.

—Frame Member—

Figure 2:
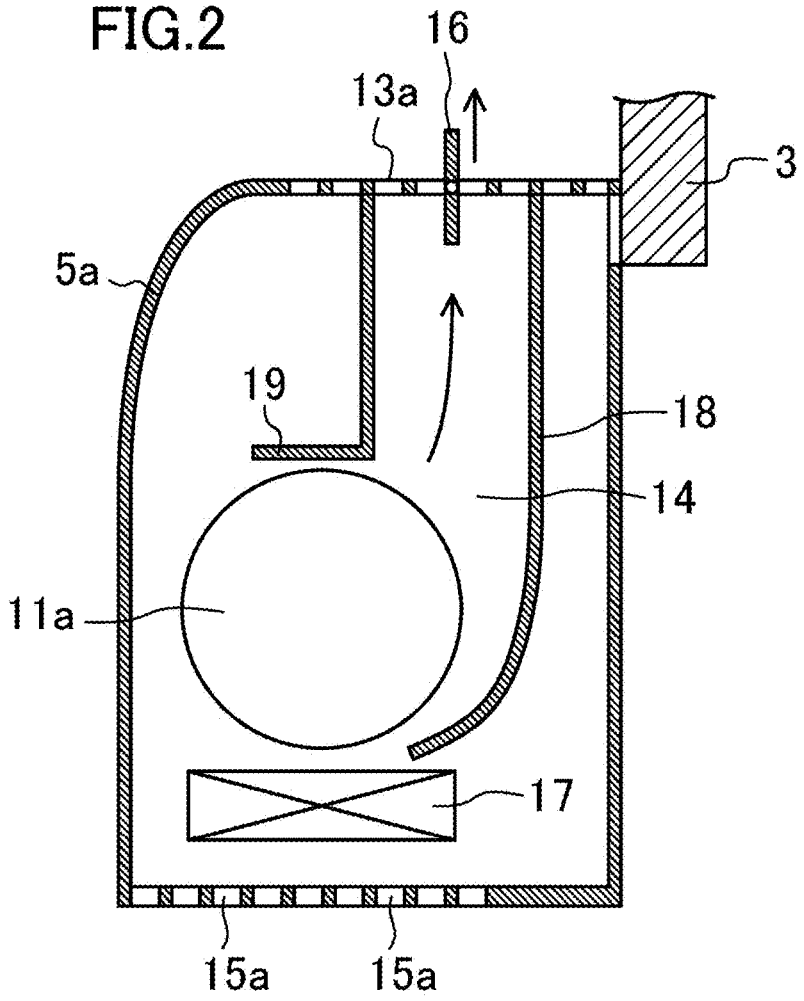
FIG. 2 is a cross-sectional view taken along line II-II shown in FIG. 1.

The configuration of the frame member (5) will be described with reference to FIGS. 1 and 2. The frame member (5) includes four blowout ports (13*a*, 13*b*, 13*c*, 13*d*) of air formed in an inner peripheral surface thereof. Each of the blowout ports (13*a*, 13*b*, 13*c*, 13*d*) is formed at a position corresponding to an associated one of sides of the panel (3). The fans (11*a*, 11*b*, 11*c*, 11*d*) are respectively provided for the blowout ports (13*a*, 13*b*, 13*c*, 13*d*). Air sent from the fans (11*a*, 11*b*, 11*c*, 11*d*) passes through the blowout ports (13*a*, 13*b*, 13*c*, 13*d*), and is blown out from the frame member (5). Each of the blowout ports (13*a*, 13*b*, 13*c*, 13*d*) causes the airflow to go toward one direction.

The first edge portion (5*a*) includes a first blowout port (13*a*), a first intake port (15*a*), a first fan (11*a*), a temperature regulator (17), and an air passage (14). The first edge portion (5*a*) has a substantially rectangular cross section.

The first blowout port (13*a*) is formed in an upper surface of the first edge portion (5*a*). The first blowout port (13*a*) is an elongated opening extending in the longitudinal direction (left-right direction) of the first edge portion (5*a*). A flap (16) is provided on the upper surface of the first edge portion (5*a*) to extend along the first blowout port (13*a*). The direction of the airflow blown out from the first blowout port (13*a*) changes depending on an inclination angle of the flap (16).

The first intake port (15*a*) is formed in a lower surface of the first edge portion (5*a*). The first intake port (15*a*) is an elongated opening extending in the longitudinal direction (left-right direction) of the first edge portion (5*a*).

The first fan (11*a*) is located between the first blowout port (13*a*) and the first intake port (15*a*). The first fan (11*a*) takes in the air outside of the frame member (5) from the first intake port (15*a*) and sends the air to the first blowout port (13*a*). The air sent from the first fan (11*a*) passes through the first blowout port (13*a*) and is blown upward.

The temperature regulator (17) is arranged between the first fan (11*a*) and the first intake port (15*a*). The temperature regulator (17) is comprised of, for example, a heat exchanger connected to an outdoor unit (not shown). When the temperature of the temperature regulator (17) is changed, the temperature of the air blown out from the first blowout port (13*a*) is regulated.

The first edge portion (5*a*) includes a front member (19) and a rear member (18). The front member (19) extends from a slightly forward position (a position toward the left in FIG. 2) on the upper surface of the first edge portion (5*a*) toward an upper surface of the first fan (11*a*). The rear member (18) extends from a slightly rearward position (a position toward the right in FIG. 2) on the upper surface of the first edge portion (5*a*) toward a lower surface of the first fan (11*a*). An air passage (14) is formed between the front member (19) and the rear member (18). The air passage (14) is formed between the first fan (11*a*) and the first blowout port (13*a*). The air passage (14) guides the air blown out from the first fan (11*a*) to the first blowout port (13*a*).

Although not shown, the second edge portion (5*b*), the third edge portion (5*c*), and the fourth edge portion (5*d*) have the same internal configuration as the first edge portion (5*a*).

The second edge portion (5*b*) includes a second blowout port (13*b*), a second intake port (15*b*), a second fan (11*b*), a temperature regulator, and an air passage. The second edge portion (5*b*) has a substantially rectangular cross section.

The second blowout port (13*b*) is formed in a lower surface of the second edge portion (5*b*). The second blowout port (13*b*) is an elongated opening extending in the longitudinal direction (left-right direction) of the second edge portion (5*b*). A flap is provided on the lower surface of the second edge portion (5*b*) to extend along the second blowout port (13*b*). The direction of the airflow blown out from the second blowout port (13*b*) changes depending on an inclination angle of the flap.

The second intake port (15*b*) is formed in an upper surface of the second edge portion (5*b*). The second intake port (15*b*) is an elongated opening extending in the longitudinal direction (left-right direction) of the second edge portion (5*b*).

The second fan (11*b*) is located between the second blowout port (13*b*) and the second intake port (15*b*). The second fan (11*b*) takes in the air outside of the frame member (5) from the second intake port (15*b*) and sends the air to the second blowout port (13*b*). The air sent from the second fan (11*b*) passes through the second blowout port (13*b*) and is blown downward.

The temperature regulator is disposed between the second fan (11*b*) and the second intake port (15*b*). The temperature regulator is comprised of, for example, a heat exchanger connected to an outdoor unit (not shown). When the temperature of the temperature regulator is changed, the temperature of the air blown out from the second blowout port (13*b*) is regulated.

The second edge portion (5*b*) includes a front member and a rear member. The front member extends from a slightly forward position on the lower surface of the second edge portion (5*b*) toward a lower surface of the second fan (11*b*). The rear member extends from a slightly rearward position on the lower surface of the second edge portion (5*b*) toward an upper surface of the second fan (11*b*). An air passage is formed between the front member and the rear member. The air passage is formed between the second fan (11*b*) and the second blowout port (13*b*). The air passage guides the air blown out from the second fan (11*b*) to the second blowout port (13*b*).

The third edge portion (5*c*) includes a third blowout port (13*c*), a third intake port (15*c*), a third fan (11*c*), a temperature regulator, and an air passage. The third edge portion (5*c*) has a substantially rectangular cross section.

The third blowout port (13*c*) is formed in a right surface of the third edge portion (5*c*). The third blowout port (13*c*) is an elongated opening extending in the longitudinal direction (vertical direction) of the third edge portion (5*c*). A flap is provided on the right surface of the third edge portion (5*c*) to extend along the third blowout port (13*c*). The direction of the airflow blown out from the third blowout port (13*c*) changes depending on an inclination angle of the flap.

The third intake port (15*c*) is formed in a left surface of the third edge portion (5*c*). The third intake port (15*c*) is an elongated opening extending in the longitudinal direction (vertical direction) of the third edge portion (5*c*).

The third fan (11*c*) is located between the third blowout port (13*c*) and the third intake port (15*c*). The third fan (11*c*) takes in the air outside of the frame member (5) from the third intake port (15*c*) and sends the air to the third blowout port (13*c*). The air sent from the third fan (11*c*) passes through the third blowout port (13*c*) and is blown out to the right.

The temperature regulator is disposed between the third fan (11*c*) and the third intake port (15*c*). The temperature regulator is comprised of, for example, a heat exchanger connected to an outdoor unit (not shown). When the temperature of the temperature regulator is changed, the temperature of the air blown out from the third blowout port (13*c*) is regulated.

The third edge portion (5*c*) includes a front member and a rear member. The front member extends from a slightly forward position on the right surface of the third edge portion (5*c*) toward a front surface of the third fan (11*c*). The rear member extends from a slightly rearward position on the right surface of the third edge portion (5*c*) toward a rear surface of the third fan (11*c*). An air passage is formed between the front member and the rear member. The air passage is formed between the third fan (11*c*) and the third blowout port (13*c*). The air passage guides the air blown out from the third fan (11*c*) to the third blowout port (13*c*).

The fourth edge portion (5*d*) includes a fourth blowout port (13*d*), a fourth intake port (15*d*), a fourth fan (11*d*), a temperature regulator, and an air passage. The fourth edge portion (5*d*) has a substantially rectangular cross section.

The fourth blowout port (13*d*) is formed in a left surface of the fourth edge portion (5*d*). The fourth blowout port (13*d*) is an elongated opening extending in the longitudinal direction (vertical direction) of the fourth edge portion (5*d*). A flap is provided on the left surface of the fourth edge portion (5*d*) to extend along the fourth blowout port (13*d*). The direction of the airflow blown out from the fourth blowout port (13*d*) changes depending on an inclination angle of the flap.

The fourth intake port (15*d*) is formed in the right surface of the fourth edge portion (5*d*). The fourth intake port (15*d*) is an elongated opening extending in the longitudinal direction (vertical direction) of the fourth edge portion (5*d*).

The fourth fan (11*d*) is located between the fourth blowout port (13*d*) and the fourth intake port (15*d*). The fourth fan (11*d*) takes in the air outside of the frame member (5) from the fourth intake port (15*d*) and sends the air to the fourth blowout port (13*d*). The air sent from the fourth fan (11*d*) passes through the fourth blowout port (13*d*) and is blown out to the left.

The temperature regulator is disposed between the fourth fan (11*d*) and the fourth intake port (15*d*). The temperature regulator is comprised of, for example, a heat exchanger connected to an outdoor unit (not shown). When the temperature of the temperature regulator is changed, the temperature of the air blown out from the fourth blowout port (13*d*) is regulated.

The fourth edge portion (5*d*) includes a front member and a rear member. The front member extends from a slightly forward position on the left surface of the fourth edge portion (5*d*) toward a front surface of the fourth fan (11*d*). The rear member extends from a slightly rearward position on the left surface of the fourth edge portion (5*d*) toward a rear surface of the fourth fan (11*d*). An air passage is formed between the front member and the rear member. The air passage is formed between the fourth fan (11*d*) and the fourth blowout port (13*d*). The air passage guides the air blown out from the fourth fan (11*d*) to the fourth blowout port (13*d*).

As described above, the blowout ports (13*a*, 13*b*, 13*c*, 13*d*) blows the air in mutually different directions. Further, the first blowout port (13*a*) and the second blowout port (13*b*) face each other, and the third blowout port (13*c*) and the fourth blowout port (13*d*) face each other. The frame member (5) produces airflows that are blown out from four different directions of the blowout ports (13*a*, 13*b*, 13*c*, 13*d*) and collide with each other, thereby producing an air current going forward to the panel (3). Specifically, the frame member (5) produces the airflows that go toward the center of the panel (3) along the surface of the panel (3) so that the airflows collide with each other in front of the center of the panel (3).

—Controller—

The controller (7) includes a processor (e.g., a microcontroller) and a memory device (e.g., a semiconductor memory) that stores software for operating the processor. The memory device also stores data required for a control operation of the controller (7).

The controller (7) adjusts the rotational speed of each fan (11*a*, 11*b*, 11*c*, 11*d*) to adjust the flow rate and flow velocity of the airflow blown out from each of the blowout ports (13*a*, 13*b*, 13*c*, 13*d*). Specifically, the controller (7) is able to individually adjust the flow rate of each of the airflows blown out from the different directions so that the sum of the flow rates of the airflows blown out from the blowout ports (13*a*, 13*b*, 13*c*, 13*d*) is kept constant. The controller (7) individually adjusts the flow rate and flow velocity of each of the airflows blown out from the blowout ports (13*a*, 13*b*, 13*c*, 13*d*) so that the direction of the air current produced by the collision of the airflows can be changed. Further, the controller (7) may adjust the rotational speeds of the fans (11*a*, 11*b*, 11*c*, 11*d*) so that the flow rate of the airflow blown out from one or more of the blowout ports (13*a*, 13*b*, 13*c*, 13*d*) is reduced to zero.

Figure 3:
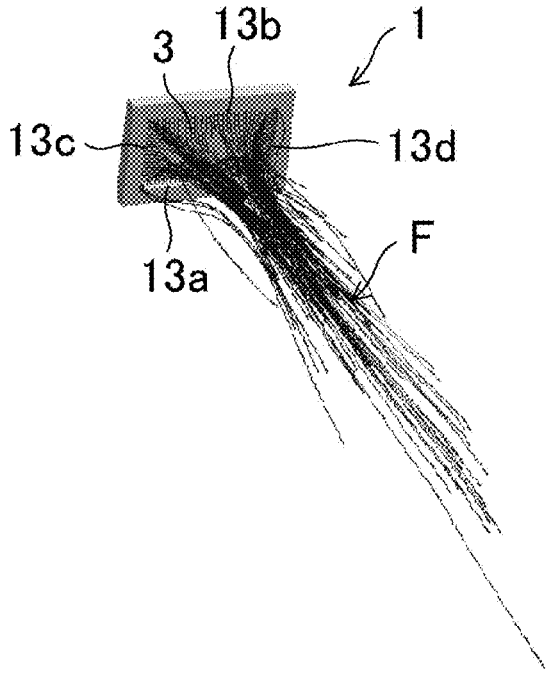
FIG. 3 is a diagram illustrating a simulation result of an air current produced by the air blower of the first embodiment when airflows have equal flow rates.
Figure 4:
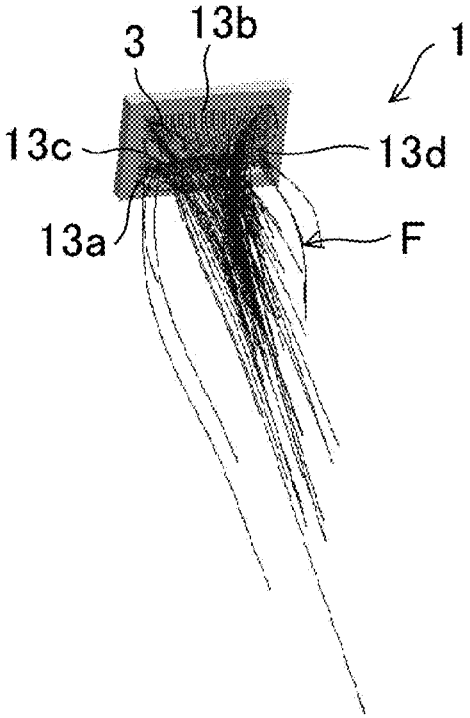
FIG. 4 is a diagram corresponding to FIG. 3, illustrating the result obtained when the flow rates of the airflows blown out from left and right blowout ports are varied.

FIGS. 3 and 4 show simulation results of the air current (F) blown out from the air blower (1) of the present embodiment.

In FIG. 3, the controller (7) makes adjustments such that the airflows blown out from the blowout ports (13*a*, 13*b*, 13*c*, 13*d*) have an equal flow rate and an equal flow velocity. In this case, the air current (F) flows approximately straight forward from the front of the center of the panel (3).

On the other hand, the controller (7) individually adjusts the rotational speeds of the fans (11*a*, 11*b*, 11*c*, 11*d*) such that the airflow from one of the blowout ports located opposite to a target direction of the air current comes at a relatively higher flow rate and a relatively higher flow velocity than the airflows blown out from the rest of the blowout ports. Further, the controller (7) adjusts the rotational speeds of the fans (11*a*, 11 *b*, 11*c*, 11*d*) so that the sum of the flow rates of the airflows blown out from the blowout ports (13*a*, 13*b*, 13*c*, 13*d*) is kept constant.

For example, when the air current is desired to be directed downward, the controller (7) increases the rotational speed of the second fan (11*b*), and lowers the rotational speeds of the first fan (11*a*), the third fan (11*c*), and the fourth fan (11*d*). This control causes the airflow blown out from the second blowout port (13*b*) to travel at a relatively higher flow rate than the airflows blown out from the first blowout port (13*a*), the third blowout port (13*c*), and the fourth blowout port (13*d*), and causes the airflow blown out from the second blowout port (13*b*) to travel at a relatively higher velocity than the airflows blown out from the first blowout port (13*a*), the third blowout port (13*c*), and the fourth blowout port (13*d*).

Further, for example, when the air current is desired to be directed rightward, the controller (7) increases the rotational speed of the third fan (11*c*), and lowers the rotational speeds of the first fan (11*a*), the second fan (11*b*), and the fourth fan (11*d*). This control causes the airflow blown out from the third blowout port (13*c*) to travel at a relatively higher flow rate than the airflows blown out from the first blowout port (13*a*), the second blowout port (13*b*), and the fourth blowout port (13*d*), and causes the airflow blown out from the third blowout port (13*c*) to travel at a relatively higher velocity than the airflows blown out from the first blowout port (13*a*), the second blowout port (13*b*), and the fourth blowout port (13*d*).

Likewise, for example, when the air current is desired to be directed diagonally to the upper left, the controller (7) increases the rotational speeds of the first fan (11*a*) and the fourth fan (11*d*), and lowers the rotational speeds of the second fan (11*b*) and the third fan (11*c*). This control causes the airflows blown out from the first blowout port (13*a*) and the fourth blowout port (13*d*) to travel at a relatively higher flow rate than the airflows blown out from the second blowout port (13*b*) and the third blowout port (13*c*), and causes the airflows blown out from the first blowout port (13*a*) and the fourth blowout port (13*d*) to travel at a relatively higher velocity than the airflows blown out from the second blowout port (13*b*) and the third blowout port (13*c*).

In the simulation result shown in FIG. 4, the airflow is blown out from the fourth blowout port (13*d*) at a higher flow rate than the airflows blown out from the rest of the blowout ports (13*a*, 13*b*, 13*c*), and at a higher flow velocity than the airflows blown out from the rest of the blowout ports (13*a*, 13*b*, 13*c*). In this case, the air current (F) flows from the front of the center of the panel (3) toward a direction opposite to the fourth blowout port (13*d*) (to the left in FIG. 4).

The controller (7) adjusts the inclination angles of the flaps (16) arranged at the respective edge portions (5*a*, 5*b*, 5*c*, 5*d*), thereby adjusting the directions of the airflows blown out from the respective blowout ports (13*a*, 13*b*, 13*c*, 13*d*). The controller (7) adjusts the directions of the airflows blown out from the blowout ports (13*a*, 13*b*, 13*c*, 13*d*) so that the direction of the air current produced by the collision of the airflows can be changed.

For example, when the air current is desired to be directed downward, the controller (7) adjusts the inclination angle of the flap of the second edge portion (5*b*) so that the airflow goes forward from the second blowout port (13*b*).

Further, for example, when the airflow is desired to be directed rightward, the controller (7) adjusts the inclination angle of the flap of the third edge portion (5*c*) so that the airflow goes forward from the third blowout port (13*c*).

Likewise, for example, when the air current is desired to be directed diagonally to the upper left, the controller (7) adjusts the inclination angles of the flaps of the first edge portion (5*a*) and the fourth edge portion (5*d*) so that the airflows go forward from the first blowout port (13*a*) and the fourth blowout port (13*d*).

The controller (7) may combine the adjustment of the rotational speed of each fan (11*a*, 11*b*, 11*c*, 11*d*) and the adjustment of the inclination angle of each flap (16) to change the direction of the air current produced by the collision of the airflows. In addition, the direction of the air current produced by the collision of the airflows may be changed through adjusting the rotational speeds of the fans (11*a*, 11*b*, 11*c*, 11*d*) only, or adjusting the inclination angles of the flaps (16) only.

—Advantages of First Embodiment—

Figure 5:
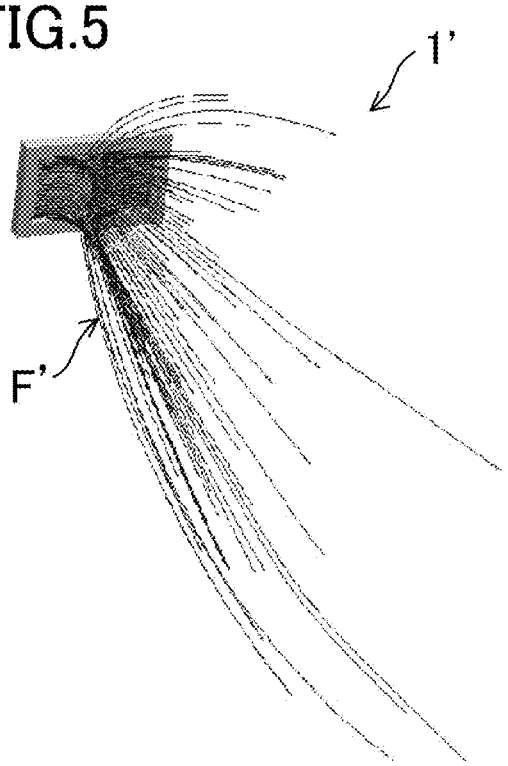
FIG. 5 is a diagram corresponding to FIG. 3, illustrating the result of a conventional air blower.

FIG. 5 shows the simulation result of an air current (F') blown out from a conventional air blower (1') that produces airflows blown out from only two edge portions facing each other, i.e., left and right edge portions, of a frame member (5). In the conventional air blower (1'), the airflows that collide with each other diffuse toward the edge portions from which no airflows is blown out (diffuse in the vertical direction). Thus, the air current that goes forward to the panel (3) has its flow rate lowered.

The air blower (1) of the present embodiment includes the panel (3), the frame member (5) arranged to surround the panel (3) and having the first to fourth blowout ports (13*a*, 13*b*, 13*c*, 13*d*), and the fans (11*a*, 11*b*, 11*c*, 11*d*) that send the air to the blowout ports (13*a*, 13*b*, 13*c*, 13*d*). The frame member (5) produces airflows that are blown out from four directions and collide with each other, thereby producing an air current that goes forward to the panel (3).

FIG. 3 shows the simulation result of the air current (F) blown out from the air blower (1) of the present embodiment. According to the present embodiment, the directions from which the airflows is blown out can be further increased than in the conventional case where the airflows is blown out from two directions and collide with each other. Therefore, as shown in FIG. 3, most of the airflows blown out from the blowout ports (13*a*, 13*b*, 13*c*, 13*d*) can be guided forward to the panel (3).

Further, in the air blower (1) of the present embodiment, the frame member (5) has the four blowout ports (13*a*, 13*b*, 13*c*, 13*d*), and each of the blowout ports (13*a*, 13*b*, 13*c*, 13*d*) formed in the frame member (5) causes the airflow to go toward one direction.

According to the present embodiment, the direction of the airflow blown out from each of the blowout ports (13*a*, 13*b*, 13*c*, 13*d*) is fixed. This causes each airflow blown out to easily go toward the target direction. Therefore, the airflows from the four directions easily collide with each other.

In the air blower (1) of the present embodiment, the panel (3) is formed in a rectangular shape, and each of the blowout ports (13*a*, 13*b*, 13*c*, 13*d*) is formed at a position corresponding to an associated one of the sides of the panel (3). That is, the first blowout port (13*a*) is arranged across the panel (3) from the second blowout port (13*b*), and the third blowout port (13*c*) is arranged across the panel (3) from the fourth blowout port (13*d*). The blowout ports (13*a*, 13*b*, 13*c*, 13*d*) cause the airflows to go toward mutually different directions.

According to the present embodiment, the airflow blown out from each of the blowout ports (13*a*, 13*b*, 13*c*, 13*d*) collides with the airflow blown out from the opposite side. This can block the collided airflows from being diffused in the directions of the airflows from the respective blowout ports (13*a*, 13*b*, 13*c*, 13*d*). Therefore, as shown in FIG. 3, most of the airflows blown out from the blowout ports (13*a*, 13*b*, 13*c*, 13*d*) can be guided forward to the panel (3).

In addition, in the air blower (1) of the present embodiment, the fans (11*a*, 11*b*, 11*c*, 11*d*) are respectively provided for the blowout ports (13*a*, 13*b*, 13*c*, 13*d*).

According to the present embodiment, the airflow can be blown out from each of the blowout ports (13*a*, 13*b*, 13*c*, 13*d*) in accordance with the fans (11*a*, 11*b*, 11*c*, and 11*d*). Thus, the flow rate of the airflow blown out from each of the blowout ports (13*a*, 13*b*, 13*c*, 13*d*) can be easily adjusted.

In the air blower (1) of the present embodiment, the fans (11*a*, 11*b*, 11*c*, 11*d*) are cross-flow fans.

According to the present embodiment, the fans (11*a*, 11*b*, 11*c*, 11*d*) can be arranged along the blowout ports (13*a*, 13*b*, 13*c*, and 13*d*) formed in the frame member (5). Thus, the airflow corresponding to the shape of each of the blowout ports (13*a*, 13*b*, 13*c*, 13*d*) can be produced.

Further, the air blower (1) of the present embodiment includes a temperature regulator (17) configured to regulate the temperature of the airflow.

According to the present embodiment, the temperature of the airflow can be changed depending on an environment or a situation. For example, the air blower (1) may be used to control the room temperature. Further, the airflow at a temperature suitable for the image displayed on the panel (3) can be produced.

In the air blower (1) of the present embodiment, the frame member (5) produces the airflows that go toward the center of the panel (3) along the surface of the panel (3) so that the airflows collide with each other in front of the center of the panel (3).

According to the present embodiment, humans cannot easily perceive that the air is blown out from the frame member (5). This allows humans facing the air blower (1) to feel as if the air is blown out from the panel (3).

In the air blower (1) of the present embodiment, the panel (3) is a painting, a photograph, or a display that displays an image.

According to the present embodiment, the air can be blown out from the periphery of an object displayed on the panel (3). Therefore, a combination of the object displayed on the panel (3) and the air can provide a sense of realism to the object displayed on the panel.

The air blower (1) of the present embodiment includes the panel (3), the frame member (5) arranged to surround the panel (3) and having the blowout ports (13*a*, 13*b*, 13*c*, 13*d*), and the fans (11*a*, 11*b*, 11*c*, 11*d*) that send the air to the blowout ports (13*a*, 13*b*, 13*c*, 13*d*). The frame member (5) produces the airflows that are blown out from different directions and collide with each other, thereby producing the air current going forward to the panel (3). The air blower (1) includes the controller (7) that adjusts the flow rate of the airflows blown out from the blowout ports (13*a*, 13*b*, 13*c*, 13*d*) to change the direction of the air current.

According to the present embodiment, the direction of the air current produced by the collision of the airflows blown out can be controlled. This can change the direction of the air current in accordance with the object displayed on the panel (3). For example, when the panel (3) displays outdoor scenery, the air blower (1) can blow the air in various directions to send the air similar to natural wind. When the panel (3) displays a moving image, the air blower (1) can give a sense of realism by changing the direction of the air in accordance with the moving image.

In the air blower (1) of the present embodiment, the controller (7) is able to adjust the flow rate of each of the airflows blown out from the different directions so that the sum of the flow rates of the airflows blown out from the blowout ports (13*a*, 13*b*, 13*c*, 13*d*) is kept constant.

According to the present embodiment, the direction of the air current can be controlled without changing the flow rates of the airflows going toward the front of the panel (3). This can offer a variety of wind that can be reproduced. Thus, the air can be sent in accordance with the object displayed on the panel (3).

Further, in the air blower (1) of the present embodiment, the blowout ports (13*a*, 13*b*, 13*c*, 13*d*) are arranged to open toward different directions, the fans (11*a*, 11*b*, 11*c*, 11*d*) are respectively provided for the blowout ports (13*a*, 13*b*, 13*c*, 13*d*), and the controller (7) adjusts the rotational speeds of the fans (11*a*, 11*b*, 11*c*, 11*d*).

According to the present embodiment, the adjustment of the rotational speeds of the fans (11*a*, 11*b*, 11*c*, 11*d*) can control the direction of the air current. This can reduce the number of parts used to control the direction of the air current. Consequently, the air blower (1) can be made compact.

—First Variation of First Embodiment—

Figure 6:
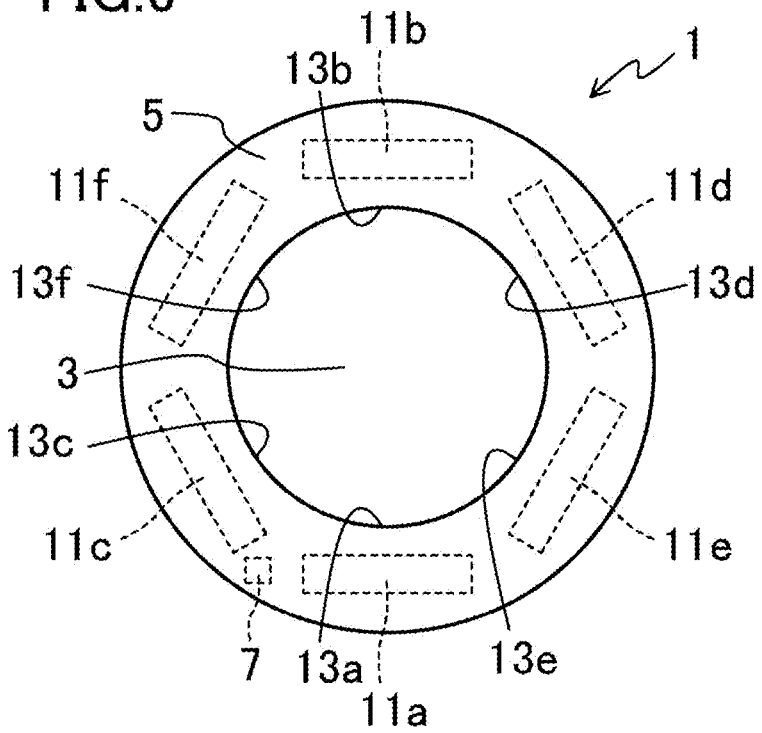
FIG. 6 is a view corresponding to FIG. 1, illustrating a first variation of the first embodiment.

In this variation, as shown in FIG. 6, the panel (3) is formed in a round shape.

The frame member (5) is arranged to surround the panel (3). Specifically, the frame member (5) is configured to have a round shape corresponding to the panel (3). The frame member (5) includes six blowout ports (13*a*, 13*b*, 13*c*, 13*d*, 13*e*, 13*f*) formed in an inner peripheral surface thereof. The blowout ports (13*a*, 13*b*, 13*c*, 13*d*, 13*e*, 13*f*) are formed at substantially equal intervals in the frame member (5) along the outer periphery of the panel (3). Fans (11*a*, 11*b*, 11*c*, 11*d*, 11*e*, 11*f*) are respectively provided for the blowout ports (13*a*, 13*b*, 13*c*, 13*d*, 13*e*, 13*f*). That is, six fans (11*a*, 11*b*, 11*c*, 11*d*, 11*e*, 11*f*) are arranged.

According to this variation, each of the blowout ports (13*a*, 13*b*, 13*c*, 13*d*, 13*e*, 13*f*) is formed in a curved shape. Thus, the airflows of multiple directions can be blown out from one of the blowout ports (13*a*, 13*b*, 13*c*, 13*d*, 13*e*, 13*f*).

—Second Variation of First Embodiment—

Figure 7:
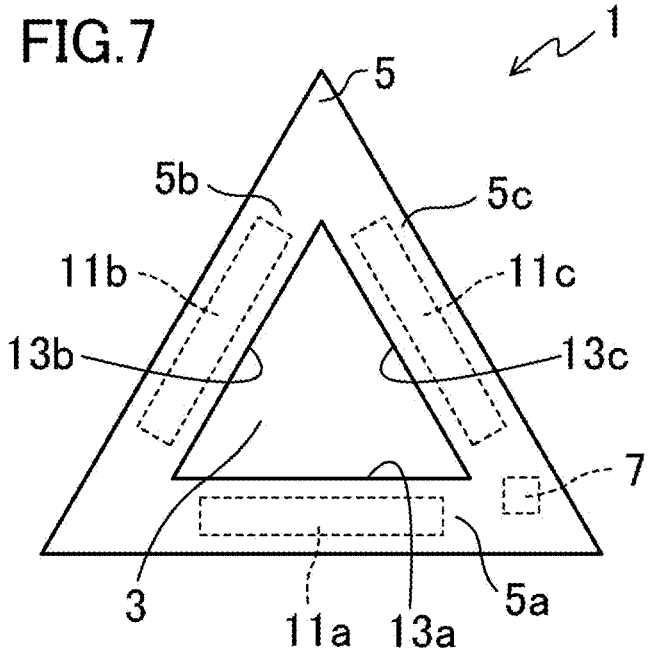
FIG. 7 is a view corresponding to FIG. 1, illustrating a second variation of the first embodiment.

In this variation, as shown in FIG. 7, the panel (3) is formed in a triangular shape.

The frame member (5) is arranged to surround the panel (3). Specifically, the frame member (5) is configured to have a triangular shape corresponding to the panel (3). The frame member (5) includes a first edge portion (5*a*), a second edge portion (5*b*), and a third edge portion (5*c*). The edge portions (5*a*, 5*b*, 5*c*) respectively include fans (11*a*, 11*b*, 11*c*) therein.

Further, each of the edge portions (5*a*, 5*b*, 5*c*) includes a blowout port (13*a*, 13*b*, 13*c*) formed in an inner peripheral surface thereof —Third Variation of First Embodiment—

Figure 8:
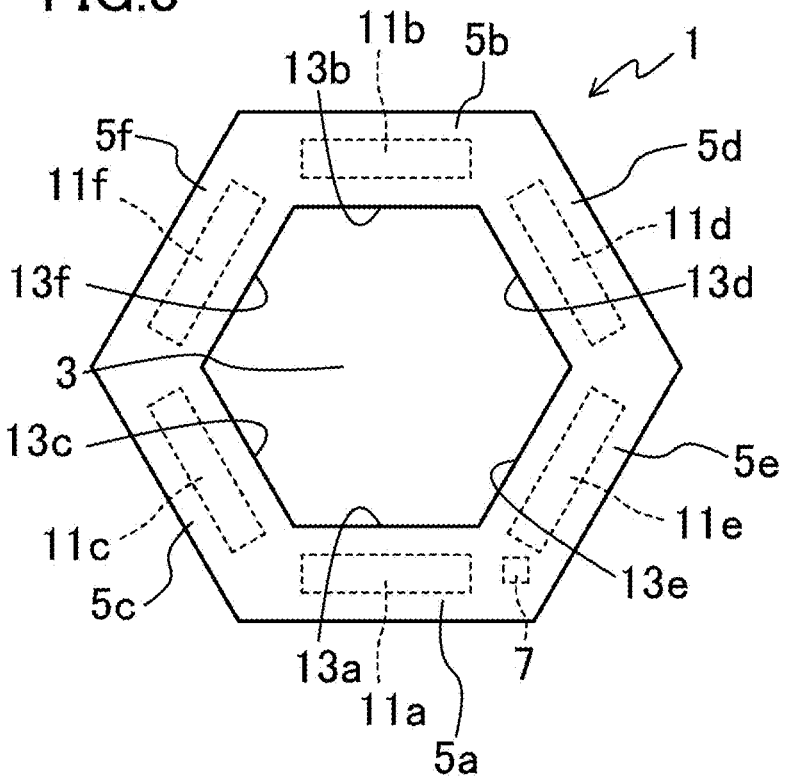
FIG. 8 is a view corresponding to FIG. 1, illustrating a third variation of the first embodiment.

In this variation, as shown in FIG. 8, the panel (3) is formed in a hexagonal shape.

The frame member (5) is arranged to surround the panel (3). Specifically, the frame member (5) is configured to have a hexagonal shape corresponding to the panel (3). The frame member (5) includes a first edge portion (5*a*), a second edge portion (5*b*), a third edge portion (5*c*), a fourth edge portion (5*d*), a fifth edge portion (5*e*), and a sixth edge portion (5*f*). The edge portions (5*a*, 5*b*, 5*c*, 5*d*, 5*e*, 5*f*) respectively include fans (11*a*, 11*b*, 11*c*, 11*d*, 11*e*, 11*f*) therein. Further, each of the edge portions (5*a*, 5*b*, 5*c*, 5*d*, 5*e*, 5*f*) includes a blowout port (13*a*, 13*b*, 13*c*, 13*d*, 13*e*, 13*f*) formed in an inner peripheral surface thereof.

Second Embodiment

Figure 9:
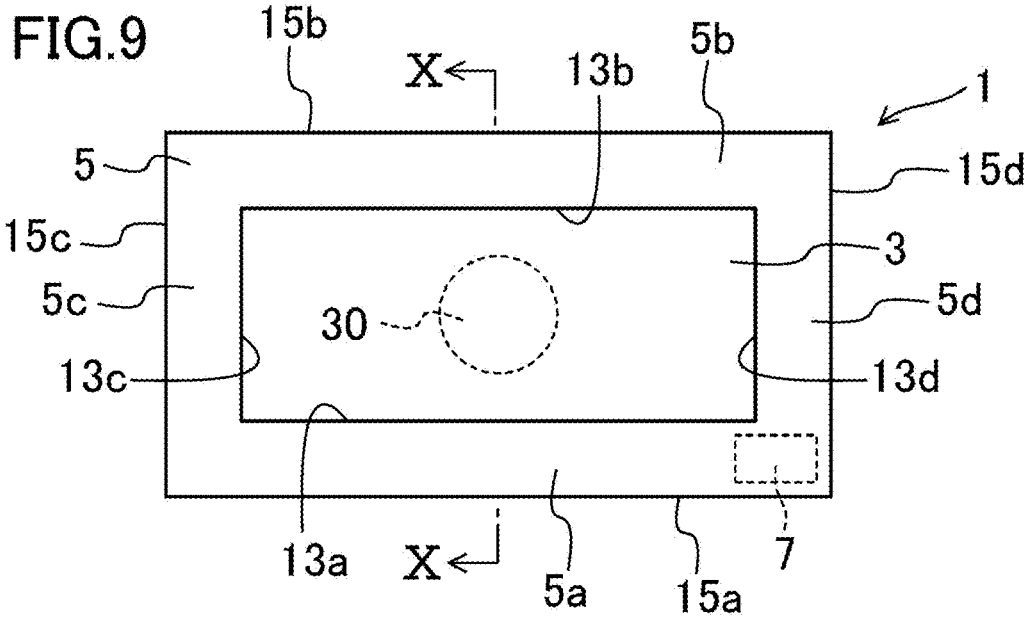
FIG. 9 is a view corresponding to FIG. 1, illustrating an air blower of a second embodiment.
Figure 10:
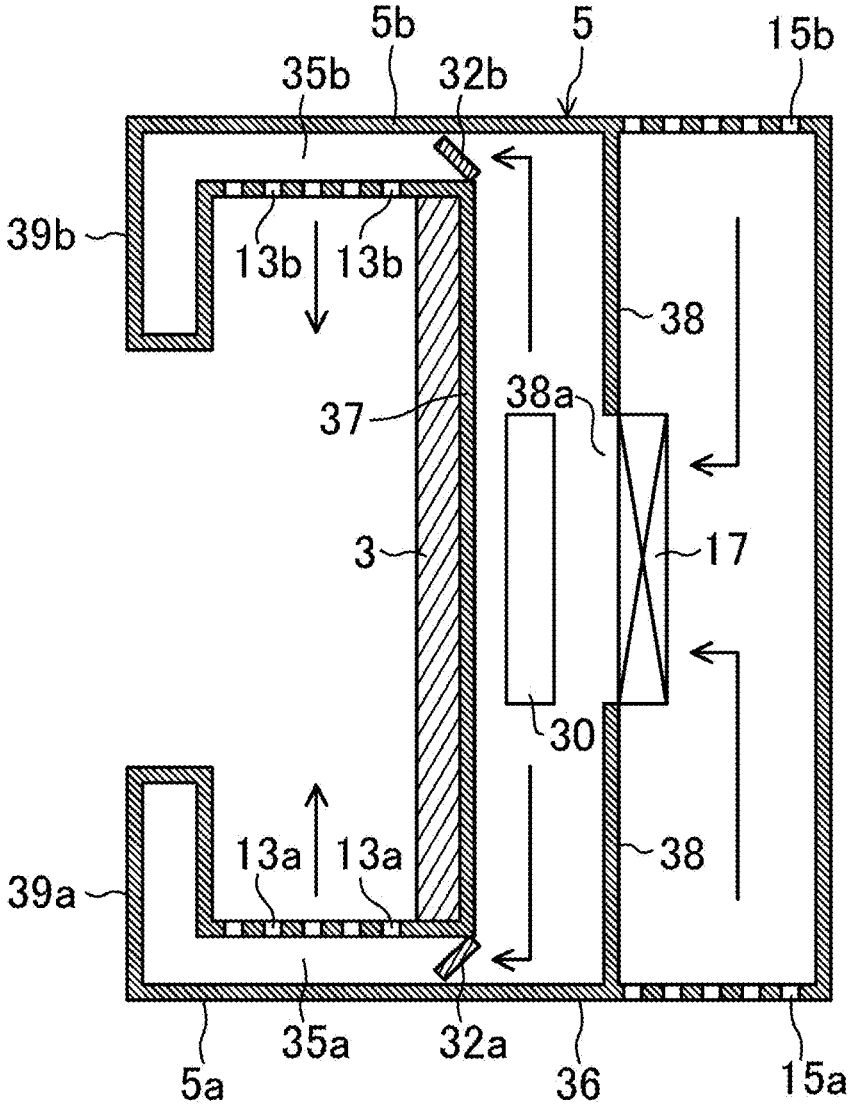
FIG. 10 is a cross-sectional view taken along line X-X shown in FIG. 9.

A second embodiment will be described below. Referring to FIGS. 9 and 10, the following description will be focused on the differences between the air blower (1) of this embodiment and the air blower (1) of the first embodiment.

—Frame Member—

The frame member (5) includes a first edge portion (5*a*), a second edge portion (5*b*), a third edge portion (5*c*), a fourth edge portion (5*d*), a base (36), a seat (37), a fan (30), a temperature regulator (17), and a controller (7).

The base (36) constitutes a portion of the frame member (5) behind the panel (3) (right side in FIG. 10). The base (36) is formed to have a hollow space inside. The inside of the base (36) is divided into front and rear spaces by a partition plate (38). A hole (38*a*) is formed in the center of the partition plate (38). The temperature regulator (17) is arranged behind the hole (38*a*). The fan (30) is arranged in front of the hole (38*a*). Intake ports (15*a*, 15*b*, 15*c*, 15*d*) are formed in outer surfaces of the base (36) behind the partition plate (38).

The seat (37) is arranged on a front end of the base (36). The seat (37) is a plate-shaped member arranged to cover a rear surface of the panel (3). The seat (37) faces forward to the air blower (1). The panel (3) is attached to the seat (37).

In the present embodiment, the fan (30) is, for example, a turbo fan. The fan (30) blows the air sucked in from the direction of a rotation axis in a circumferential direction. The single fan (30) is arranged in front of the hole (38*a*). The fan (30) sends the air taken in from the intake ports (15*a*, 15*b*, 15*c*, 15*d*) to the blowout ports (13*a*, 13*b*, 13*c*, 13*d*).

One temperature regulator (17) is arranged behind the fan (30). The intake ports (15*a*, 15*b*, 15*c*, 15*d*) are formed around the temperature regulator (17).

The first edge portion (5*a*) extends forward from a lower end of the base (36). The first edge portion (5*a*) is arranged along a lower long side of the panel (3). The first edge portion (5*a*) extends over the entire length of the long side of the panel (3). A front end portion (39*a*) of the first edge portion (5*a*) is formed to extend upward. The first edge portion (5*a*) includes first blowout ports (13*a*), a first air passage (35*a*), and a first damper (32*a*).

The first blowout ports (13*a*) are arranged in a left-right direction in an upper surface of the first edge portion (5*a*) to be located between the front end portion (39*a*) and the seat (37). The first blowout ports (13*a*) cause the air sent from the fan (30) to flow upward.

The first air passage (35*a*) is formed by an internal space of the first edge portion (5*a*). The first damper (32*a*) is arranged behind the first blowout ports (13*a*) in the first air passage (35*a*). The first damper (32*a*) is a damper that has a variable opening degree and adjusts a flow rate. The first air passage (35*a*) guides the air sent from the fan (30) to the first blowout ports (13*a*).

The second edge portion (5*b*) extends forward from an upper end of the base (36). The second edge portion (5*b*) is arranged along an upper long side of the panel (3). The second edge portion (5*b*) extends over the entire length of the long side of the panel (3). A front end portion (39*b*) of the second edge portion (5*b*) is formed to extend downward. The second edge portion (5*b*) includes second blowout ports (13*b*), a second air passage (35*b*), and a second damper (32*b*).

The second blowout ports (13*b*) are arranged in a left-right direction in a lower surface of the second edge portion (5*b*) to be located between the front end portion (39*b*) and the seat (37). The second blowout ports (13*b*) causes the air sent from the fan (30) to flow downward.

The second air passage (35*b*) is formed by an internal space of the second edge portion (5*b*). The second damper (32*b*) is arranged behind the second blowout ports (13*b*) in the second air passage (35*b*). The second damper (32*b*) is a damper that has a variable opening degree and adjusts a flow rate. The second air passage (35*b*) guides the air sent from the fan (30) to the second blowout ports (13*b*).

Although not shown, the third edge portion (5*c*) and the fourth edge portion (5*d*) have the same internal configuration as the first edge portion (5*a*) and the second edge portion (5*b*).

The third edge portion (5*c*) extends forward from a left end of the base (36). The third edge portion (5*c*) is arranged along a left short side of the panel (3). The third edge portion (5*c*) extends over the entire length of the short side of the panel (3). A front end portion of the third edge portion (5*c*) is formed to extend to the right. The third edge portion (5*c*) includes third blowout ports (13*c*), a third air passage, and a third damper.

The third blowout ports (13*c*) are arranged in a vertical direction in a right surface of the third edge portion (5*c*) to be located between the front end portion and the seat (37). The third blowout ports (13*c*) cause the air sent from the fan (30) to flow to the right.

The third air passage is formed by an internal space of the third edge portion (5*c*). The third damper is arranged behind the third blowout ports (13*c*) in the third air passage. The third damper is a damper that has a variable opening degree and adjusts a flow rate. The third air passage guides the air sent from the fan (30) to the third blowout ports (13*c*).

The fourth edge portion (5*d*) extends forward from a right end of the base (36). The fourth edge portion (5*d*) is arranged along a right short side of the panel (3). The fourth edge portion (5*d*) extends over the entire length of the short side of the panel (3). A front end portion of the fourth edge portion (5*d*) is formed to extend to the left. The fourth edge portion (5*d*) includes fourth blowout ports (13*d*), a fourth air passage, and a fourth damper.

The fourth blowout ports (13*d*) are arranged in a vertical direction in a left side surface of the fourth edge portion (5*d*) to be located between the front end portion and the seat (37). The fourth blowout ports (13*d*) cause the air sent from the fan (30) to flow to the left.

The fourth air passage is formed by an internal space of the fourth edge portion (5*d*).

The fourth damper is arranged behind the fourth blowout ports (13*d*) in the fourth air passage. The fourth damper is a damper that has a variable opening degree and adjusts a flow rate. The fourth air passage guides the air sent from the fan (30) to the fourth blowout ports (13*d*).

As described above, a plurality of air passages (35*a*, 35*b*) are arranged to correspond to the blowout ports (13*a*, 13*b*, 13*c*, 13*d*). The air blown out from the fan (30) is distributed to each of the blowout ports (13*a*, 13*b*, 13*c*, 13*d*) through a corresponding one of the air passages (35*a*, 35*b*).

—Controller—

The controller (7) adjusts the opening degree of each damper to adjust the flow rate and flow velocity of the airflow blown out from each of the blowout ports (13*a*, 13*b*, 13*c*, 13*d*).

—Advantages of Second Embodiment—

In the air blower (1) of the present embodiment, the frame member (5) includes the air passages (35*a*, 35*b*) that guide the air blown out from the fan (30) to the blowout ports (13*a*, 13*b*, 13*c*, 13*d*).

According to the present embodiment, the fan (30) can be provided behind the panel (3). Therefore, it is not necessary to provide a space for arranging the fan (30) in each of the edge portions (5*a*, 5*b*, 5*c*, 5*d*) of the frame member (5), and the edge portions (5*a*, 5*b*, 5*c*, 5*d*) can be made compact.

In the air blower (1) of the present embodiment, a plurality of blowout ports (13*a*, 13*b*, 13*c*, 13*d*) are formed, and the air passages (35*a*, 35*b*) distribute the air blown out from the single fan (30) to the plurality of blowout ports (13*a*, 13*b*, 13*c*, 13*d*).

According to the present embodiment, the number of fans (30) can be smaller than the number of blowout ports (13*a*, 13*b*, 13*c*, 13*d*). This can make the frame member (5) more compact.

In the air blower (1) of the present embodiment, the blowout ports (13*a*, 13*b*, 13*c*, 13*d*) are arranged to open toward different directions. The frame member (5) includes the air passages (35*a*, 35*b*) that are arranged to correspond to the blowout ports (13*a*, 13*b*, 13*c*, 13*d*) and guide the air sent from the fan (30) to the blowout ports (13*a*, 13*b*, 13*c*, 13*d*). Each air passage (35*a*, 35*b*) is provided with the damper (32*a*, 32*b*) that has a variable opening degree and adjusts the flow rate. The controller (7) adjusts the opening degrees of the dampers (32*a*, 32*b*) to adjust the flow rate and flow velocity of the airflow blown out from each of the blowout ports (13*a*, 13*b*, 13*c*, 13*d*).

According to the present embodiment, even when the fan (30) is arranged away from the blowout ports (13*a*, 13*b*, 13*c*, 13*d*), the flow rate and flow velocity of the airflow blown out from each of the blowout ports (13*a*, 13*b*, 13*c*, and 13*d*) can be adjusted.

—First Variation of Second Embodiment—

Figure 11:
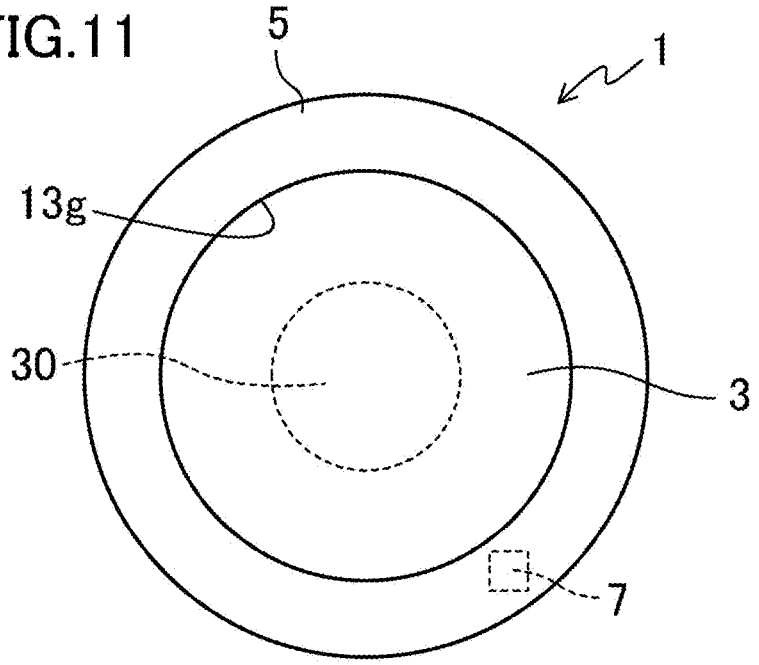
FIG. 11 is a view corresponding to FIG. 1, illustrating a first variation of the second embodiment.

In this variation, as shown in FIG. 11, the panel (3) is formed in a round shape.

The frame member (5) is arranged to surround the panel (3). Specifically, the frame member (5) is configured to have a round shape corresponding to the panel (3). The frame member (5) includes a single blowout port (13*g*) formed along the entire inner peripheral surface thereof.

Note that the blowout port (13*g*) may not extend along the entire periphery, and may be divided into continuously arranged blowout ports. In this case, the frame member (5) is provided with a plurality of blowout ports (13*g*) arranged in the circumferential direction thereof —Second Variation of Second Embodiment—

Figure 12:
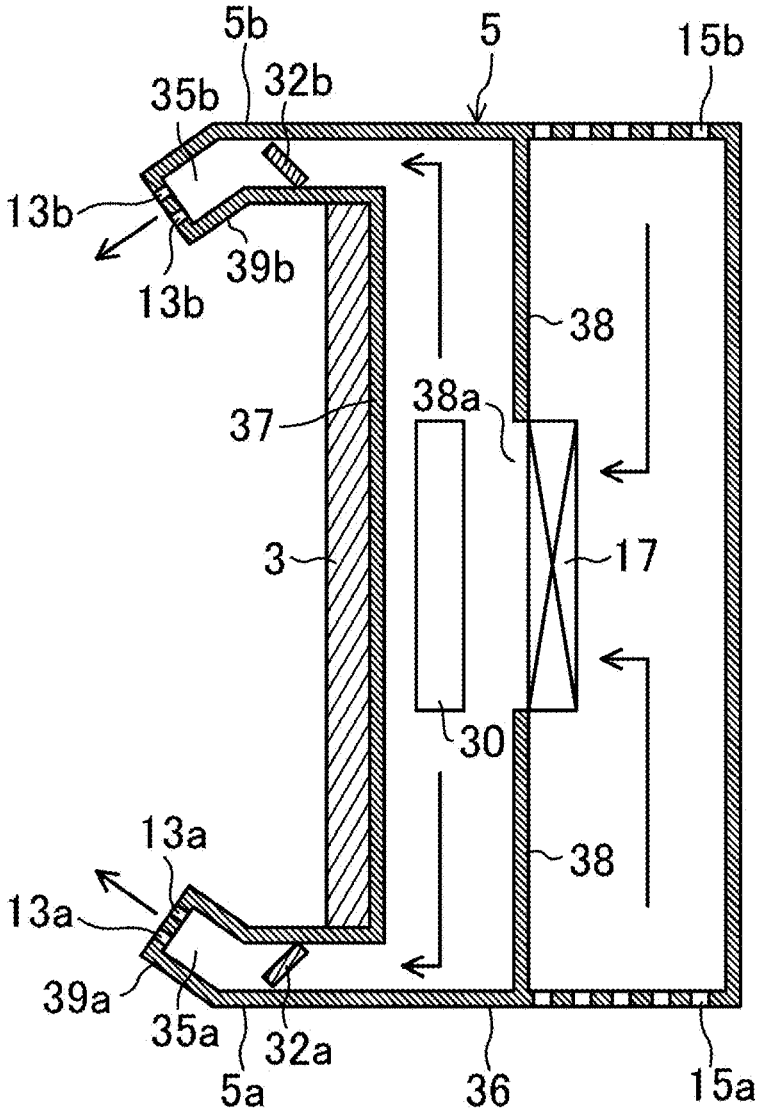
FIG. 12 is a view corresponding to FIG. 10, illustrating a second variation of the second embodiment.

In this variation, as shown in FIG. 12, front end portions (39*a*, 39*b*) of the frame member (5) are formed to extend obliquely forward to the panel (3) toward the center of the panel (3). The blowout ports (13*a*, 13*b*, 13*c*, 13*d*) are formed in a front end of the frame member (5). Therefore, the frame member (5) produces the airflows that go obliquely forward to the panel (3) toward the center of the panel (3) so that the airflows collide with each other in front of the center of the panel (3).

Other Embodiments

In the air blower (1) according to each of the above-described embodiments, the controller (7) may adjust the directions of the airflows to change the direction of the air current produced by the collision of the airflows blown out.

In the air blower (1) according to each of the above-described embodiments, the controller (7) may adjust the flow rate of the airflow blown out from each of the blowout ports (13*a*, 13*b*, 13*c*, 13*d*, 13*e*, 13*f*, 13*g*) so as not to keep the sum of the flow rates of the airflows blown out from the blowout ports (13*a*, 13*b*, 13*c*, 13*d*, 13*e*, 13*f*, 13*g*) constant. For example, the flow rate of the airflow blown out from one or more of the blowout ports may be increased, and the flow rate of the airflow blown out from the rest of the blowout ports may be kept unchanged. Further, for example, the flow rate of the airflow blown out from one or more of the blowout ports may be lowered, and the flow rate of the airflow blown out from the rest of the blowout ports may be kept unchanged.

In the air blower (1) of each of the above-described embodiments, the controller (7) may adjust one of the flow rate, flow velocity, and direction of the airflows to change the direction of the air current produced by the collision of the airflows blown out. Specifically, the controller may only adjust at least one of the flow rate, flow velocity, and direction of the airflows blown out from the blowout ports (13*a*, 13*b*, 13*c*, 13*d*, 13*e*, 13*f*, 13*g*).

In the air blower (1) of each of the above-described embodiments, a heat exchanger connected to an outdoor unit has been described as the temperature regulator (17). However, the temperature regulator (17) is not limited thereto, and a heater, or a Peltier element, for example, may be used.

Further, as the fan (11*a*, 11*b*, 11*c*, 11*d*, 11*e*, 11*f*, 30) of the air blower (1) of each of the above-described embodiments, a propeller fan, a sirocco fan, or a mixed flow fan may be used.

The air blower (1) according to each of the above-described embodiments may be provided with a humidifier or an aroma diffuser.

Further, the air blower (1) according to each of the above-described embodiments may be partially embedded in a wall of the room.

In the air blower (1) of each of the above-described embodiments, the panel (3) may be plate-shaped glass (e.g., glass constituting a fixed window). Further, the panel (3) is not limited to be flat, and may be slightly curved, for example.

While the embodiments and variations thereof have been described above, it will be understood that various changes in form and details may be made without departing from the spirit and scope of the claims. The foregoing embodiments and variations thereof may be combined and replaced with each other without deteriorating intended functions of the present disclosure.

INDUSTRIAL APPLICABILITY

As can be seen from the foregoing description, the present disclosure is useful for an air blower.

EXPLANATION OF REFERENCE

1 Air Blower
3 Panel
5 Frame Member
7 Controller
11*a*, 11*b*, 11*c*, 11*d*, 11*e*, 11*f* Fan
13*a* First Blowout Port (Blowout Port)
13*b* Second Blowout Port (Blowout Port)
13*c* Third Blowout Port (Blowout Port)
13*d* Fourth Blowout Port (Blowout Port)
13*e*, 13*f*, 13*g* Blowout Port
14 Air Passage
17 Temperature Regulator
30 Fan
32*a* First Damper (Damper)
32*b* Second Damper (Damper)
35*a* First Air Passage (Air Passage)
35*b* Second Air Passage (Air Passage)

The invention claimed is:

1. An air blower comprising:
a panel (3);
a frame member (5) that is arranged to surround the panel (3) and has four blowout ports (13*a*, 13*b*, 13*c*, 13*d*) of air formed therein; and
a fan (11*a*, 11*b*, 11*c*, 11*d*) that sends air to the four blowout ports (13*a*, 13*b*, 13*c*, 13*d*), respectively,
the four blowout ports (13*a*, 13*b*, 13*c*, 13*d*) of the frame member (5) including a first blowout port (13*a*), a second blowout port (13*b*), a third blowout port (13*c*), and a fourth blowout port (13*d*),
the first blowout port (13*a*) being arranged across the panel (3) from the second blowout port (13*b*),
the third blowout port (13*c*) being arranged across the panel (3) from the fourth blowout port (13*d*),
the four blowout ports (13*a*, 13*b*, 13*c*, 13*d*) causing airflows to be blown out in mutually different directions,
the frame member (5) causing the airflows respectively blown out from the first blowout port (13*a*), the second blowout port (13*b*), the third blowout port (13*c*), and the fourth blowout port (13*d*) to collide with each other, thereby producing an air current going forward relative to the panel (3).

2. The air blower of claim 1, wherein
the panel (3) is formed in a rectangular shape, and
each of the four blowout ports (13*a*, 13*b*, 13*c*, 13*d*) is formed at a position corresponding to an associated one of sides of the panel (3).

3. The air blower of claim 1, wherein
the panel (3) is formed in a round shape, and
the four blowout ports (13*a*, 13*b*, 13*c*, 13*d*) are formed along an outer periphery of the panel (3).

4. The air blower of claim 1, wherein
The fan (11*a*, 11*b*, 11*c*, 11*d*) is provided for each of the four blowout ports (13*a*, 13*b*, 13*c*, 13*d*).

5. The air blower of claim 4, wherein
the fans (11*a*, 11*b*, 11*c*, 11*d*) are cross-flow fans.

6. The air blower of claim 4, further comprising:
a controller (7) that adjusts at least one of a flow velocity, flow rate, and direction of the airflows blown out from each of the four blowout ports (13*a*, 13*b*, 13*c*, 13*d*) to change a direction of the air current, wherein the controller (7) adjusts rotational speeds of the fans (11*a*, 11*b*,11*c*, 11*d*).

7. The air blower of claim 1, wherein the frame member (5) includes an air passage (14) that guides the air blown out from the fan (11*a*, 11*b*, 11*c*, 11*d*) to the four blowout ports (13*a*, 13*b*, 13*c*, 13*d*).

8. The air blower of claim 1, wherein the frame member (5) blows out the airflows that go toward a center of the panel (3) along a surface of the panel (3) so that the airflows collide with each other in front of the center of the panel (3).

9. The air blower of claim 1, wherein the panel (3) is a painting, a photograph, or a display that displays an image.

10. The air blower of claim 1, further comprising:

a controller (7) that adjusts at least one of a flow velocity, flow rate, and direction of the airflows blown out from the four blowout ports (13*a*, 13*b*, 13*c*, 13*d*) to change a direction of the air current.

11. The air blower of claim 10, wherein the controller (7) is able to adjust the flow rate of each of the airflows blown out from the different directions so that the sum of the flow rates of the airflows blown out from the four blowout ports (13*a*, 13*b*, 13*c*, 13*d*) is kept constant.

12. The air blower of claim 1, further comprising a controller (7) that adjusts a flow velocity and/or a flow rate of each of the airflows blown out from the first blowout port (13*a*), the second blowout port (13*b*), the third blowout port (13*c*), and the fourth blowout port (13*d*) individually to change a direction of the air current going forward relative to the panel (3).

13. The air blower of claim 12, wherein the controller (7) adjusts the flow velocity and the flow rate of each of the airflows blown out from the first blowout port (13*a*), the second blowout port (13*b*), the third blowout port (13*c*), and the fourth blowout port (13*d*) individually such that:

an airflow from one of the four blowout ports that is located opposite to a target direction of the air current going forward from the panel (3) comes at a relatively higher flow rate than the airflows blown out from rest of the four blowout ports; and the airflow from the one of the four blowout ports that is located opposite to the target direction of the air current going forward from the panel (3) comes at a relatively higher flow velocity than the airflows blown out from the rest of the four blowout ports.

* * * * *